US009784100B2

(12) United States Patent
Haberer et al.

(10) Patent No.: US 9,784,100 B2
(45) Date of Patent: Oct. 10, 2017

(54) SMART FLOWBACK ALARM TO DETECT KICKS AND LOSSES

(71) Applicants: Sven M. Haberer, Houston, TX (US); Tarab H. Ali, Conroe, TX (US); Ian P. Says, Spring, TX (US); Moray L. Laing, Spring, TX (US); John P. Lottinville, Houston, TX (US); Bryan C. Dugas, Breaux Bridge, LA (US)

(72) Inventors: Sven M. Haberer, Houston, TX (US); Tarab H. Ali, Conroe, TX (US); Ian P. Says, Spring, TX (US); Moray L. Laing, Spring, TX (US); John P. Lottinville, Houston, TX (US); Bryan C. Dugas, Breaux Bridge, LA (US)

(73) Assignee: BAKER HUGHES INCORPORATED, Houston, TX (US)

( * ) Notice: Subject to any disclaimer, the term of this patent is extended or adjusted under 35 U.S.C. 154(b) by 1131 days.

(21) Appl. No.: 13/853,391

(22) Filed: Mar. 29, 2013

(65) Prior Publication Data

US 2013/0325351 A1 Dec. 5, 2013

Related U.S. Application Data

(60) Provisional application No. 61/654,604, filed on Jun. 1, 2012.

(51) Int. Cl.
*E21B 49/08* (2006.01)
*E21B 47/10* (2012.01)
(Continued)

(52) U.S. Cl.
CPC ..... *E21B 49/08* (2013.01); *E21B 21/08* (2013.01); *E21B 44/00* (2013.01); *E21B 47/10* (2013.01)

(58) Field of Classification Search
CPC ..... E21B 44/00; E21B 21/08; E21B 47/10; E21B 49/008; E21B 49/00; E21B 43/00
See application file for complete search history.

(56) References Cited

U.S. PATENT DOCUMENTS 5,080,182 A * 1/1992 Thompson ..... E21B 49/005 175/48
5,454,436 A 10/1995 Jardine et al.
(Continued)

FOREIGN PATENT DOCUMENTS

EP 0718641 A2 6/1996

OTHER PUBLICATIONS

International Search Report and Written Opinion dated Aug. 23, 2013 for International Application No. PCT/US2013/042862; all references in PCT cited above.

*Primary Examiner* — Mohamed Charioui
*Assistant Examiner* — Jeremy Delozier
(74) *Attorney, Agent, or Firm* — Cantor Colburn LLP

(57) ABSTRACT

A method, apparatus and computer-readable medium for determining an influx at a wellbore is provided. A flowback parameter is obtained for a plurality of flowback events at the wellbore prior to a current flowback event. An average of the flowback parameter (μ) and a standard deviation (σ) of the flowback parameter is determined from the plurality of prior flowback parameters. An alarm threshold is set based on the determined average and the standard deviation. A current flowback parameter is measured and the influx is determined when the current flowback parameter meets the alarm threshold.

20 Claims, 3 Drawing Sheets

(51) Int. Cl.
*E21B 44/00* (2006.01)
*E21B 21/08* (2006.01)

(56) References Cited

U.S. PATENT DOCUMENTS

| | | | | |
|---|---|---|---|---|
| 5,952,569 | A | 9/1999 | Jervis et al. | |
| 6,234,250 | B1 | 5/2001 | Green et al. | |
| 6,820,702 | B2 | 11/2004 | Niedermayr et al. | |
| 2006/0016592 | A1* | 1/2006 | Wu | E21B 21/08 166/250.07 |
| 2010/0211423 | A1* | 8/2010 | Hehmeyer | G01V 1/40 702/6 |
| 2011/0220410 | A1 | 9/2011 | Aldred et al. | |

* cited by examiner

SMART FLOWBACK ALARM TO DETECT KICKS AND LOSSES

CROSS REFERENCE TO RELATED APPLICATION

The present application claims priority from U.S. Provisional Application Ser. No. 61/654,604, filed Jun. 1, 2012.

BACKGROUND OF THE DISCLOSURE

1. Field of the Disclosure

The present disclosure is related to drilling operations and in particular to methods for determining an occurrence of a kick or loss in flowback events.

2. Description of the Related Art

When drilling a wellbore in a formation, drilling fluid is circulated from a surface location to a downhole location by being pumped downward through an inside of a drill string and back to the surface by flowing upward in an annulus between the drill string and the wellbore. When pumping stops, a certain amount of drill fluid, often between 20 to 50 barrels, flows back to the fluid holding tanks. The rate of change in fluid volume (in fluid holding tanks) with time after the pumps have been shut off is known as flowback. Flowback typically comes from various types of surface equipment draining back drilling fluid to the fluid holding tanks. Such flowback, when shutting off the pumps is considered normal. However, a kick can also occur during such occasions, in which fluid flows into the wellbore from the formation. If this formation fluid flow into the wellbore occurs in an uncontrollable manner, a much more dangerous event can occur such as a blowout. Thus, early detection of kicks is of particular interest to drilling operators. The present disclosure therefore provides a method of determining whether a current flowback is a normal flowback or represents a kick.

SUMMARY OF THE DISCLOSURE

In one aspect, the present disclosure provides a method of determining an influx at a wellbore, the method including obtaining a flowback parameter for a plurality of flowback events at the wellbore prior to a current flowback event; determining an average of the flowback parameter ($\mu$) and a standard deviation ($\sigma$) of the flowback parameter from the plurality of prior flowback parameters; setting an alarm threshold based on the determined average and the standard deviation; measuring a current flowback parameter; and determining the influx when the current flowback parameter meets the alarm threshold.

In another aspect, the present disclosure provides an apparatus for determining an influx at a wellbore, the apparatus including: a sensor configured to obtain a parameter of a current flowback; and a processor configured to: determine an average flowback parameter ($\mu$) and a standard deviation ($\sigma$) of the parameter for prior flowbacks, set an alarm threshold based on the determined average and standard deviation, compare the measured current parameter to the alarm threshold, and trigger an alarm to indicate the influx when the current parameter meets the alarm threshold.

In yet another aspect, the present disclosure provides a computer-readable medium accessible to a processor and having instructions stored thereon that when read by the processor enable the processor to perform a method of determining an influx at a wellbore, the method including: obtaining a flowback parameter for plurality of flowback events at the wellbore prior to a current flowback event; determining an average of the flowback parameter ($\mu$) and a standard deviation ($\sigma$) of the flowback parameter from the plurality of prior flowback parameters; setting an alarm threshold based on the determined average and the standard deviation; measuring a current flowback parameter; and determining the influx when the current flowback parameter meets the alarm threshold.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DETAILED DESCRIPTION OF THE DISCLOSURE

Figure 1:
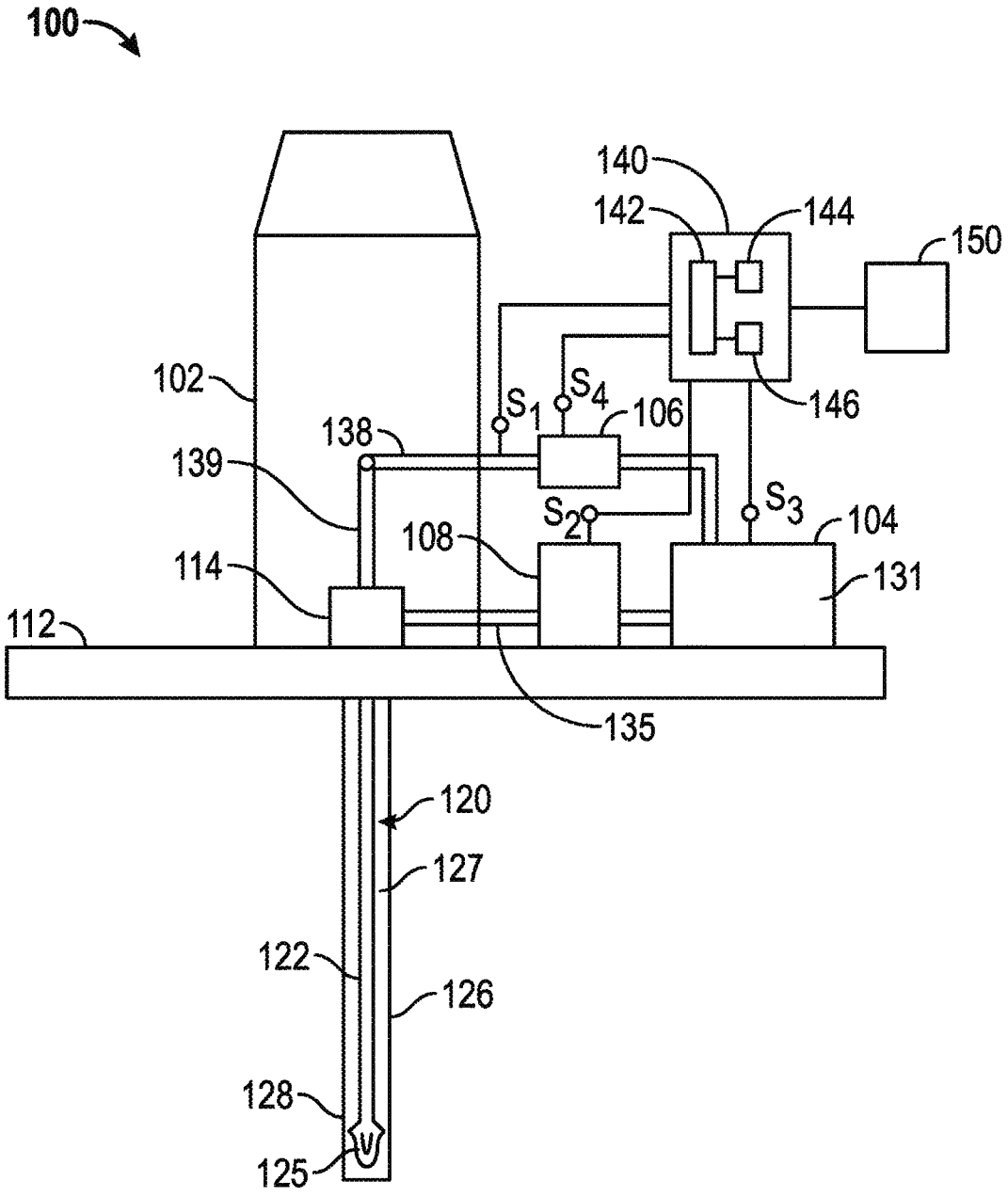
FIG. 1 shows a schematic diagram of an exemplary drilling system is suitable for use with the present disclosure.

FIG. 1 shows a schematic diagram of an exemplary drilling system 100 that is suitable for use with the present disclosure. The exemplary drilling system 100 includes a drillstring 120 carrying a drill bit 125 conveyed in a "wellbore" or "borehole" 126 for drilling the wellbore. The drilling system 100 includes a conventional derrick 102 erected on a floor 112 which supports a rotary table 114 that rotates the drillstring 120. The drillstring 120 includes tubing such as a drill pipe or a coiled-tubing 122 extending downward from the surface into the borehole 126. The drill bit 125 attached to the end of the drillstring 120 breaks up geological formations when it is rotated to drill the borehole 126. During drilling operations, a downward force is applied to the drillstring 120 to advance the drillstring 120 into the borehole 126.

During drilling operations, a suitable drilling fluid 131 from a drilling fluid storage system 104 is circulated under pressure through a channel in the drillstring 120 by a mud pump 106. The drilling fluid 131 passes from the mud pump 106 into the drillstring 120 via a desurger (not shown), fluid line 138 and Kelly joint 139. The drilling fluid 131 is discharged at the borehole bottom 128 through an opening in the drill bit 125. The drilling fluid 131 circulates uphole through an annular space 127 between the drillstring 120 and the borehole 126 and returns to the drilling fluid storage system 104 via a return line 135 and return system 108. The drilling fluid acts to lubricate the drill bit 125 and to carry borehole cutting or chips away from the drill bit 125. A sensor $S_1$ placed in the fluid line 138 provides information about the fluid flow rate. In addition, similar information is provided via a sensor $S_2$ placed at the return system 108 and/or sensor $S_3$ placed at the drilling fluid storage system 104. Sensors $S_1$, $S_2$ and $S_3$ can provide information such as fluid flow rate, fluid volume, and/or fluid volume change rates. Other sensors providing this information can also be disposed at various locations along the flow of the drilling fluid. Sensor $S_4$ is provided at pump 106 to measure pump rates and pump pressure. Signals from sensors $S_4$ can be used to determine a "pumps off" event when the drilling pump 106 is turned off, indicating an onset of flowback.

The exemplary drilling system 100 further includes a surface control unit 140 and a display and alarm system 150 configured to provide information relating to the drilling operations and for controlling certain aspects of the drilling operations. In one aspect, the surface control unit 140 can be a computer-based system that includes one or more processors (such as microprocessors) 142, one or more data storage devices (such as solid state-memory, hard drives, tape drives, etc.) 144 for storing programs or models and data, and computer programs and models 146 for use by the processor 142. In one aspect, the surface control unit 140 receives signals from the sensors $S_1$-$S_4$ and processes such signals according to programmed instructions at the surface control unit 140. The surface control unit 140 calculates various values disclosed herein and displays these values and information at the display and alarm system 150. In one embodiment, the surface control unit 140 receives flow rate data and/or rate of change in volume and outputs a data set that includes flow rate averages and standard deviations to the display and alarm system 150. The display and alarm system 150 triggers an alarm, also referred to herein as a "smart alarm," such as a visual or audible indication, when a selected alarm condition is met, as discussed below. In another embodiment, the display and alarm system 150 provides a signal to the control unit 140 when the alarm condition is met and the control unit 140 performs an action to address the alarm condition, for instance, an action that reduces the influx. The display and alarm system 150 can also provide the alarm signal to an operator to prompt the operator into taking an action.

In a normal flowback, the drilling fluid from the surface equipment and return lines 135 drains back to the fluid storage system once the pump is shut off. However, when the hydrostatic pressure exerted on the formation by the drilling fluid column is insufficient to hold the formation fluid in the formation, the formation fluid can flow into the borehole. This influx of formation fluid into the wellbore is known as a kick, and is generally undesirable. In addition, when the downhole drilling fluid pressure is greater than the formation fluid pressure, drilling fluid can infiltrate the formation. This drilling fluid infiltration is known as a loss and is also undesirable.

The present disclosure provides a system for detecting a flowback event that lies outside a normal flowback condition, such as a kick or a loss, and for triggering an alarm or automatically performing an action when such an abnormal flowback is detected. In one embodiment, statistics are obtained for parameter measurements obtained during prior flowbacks, and the values of the current flowback are compared to the obtained statistics in order to determine whether or not a current flowback parameter is a normal flowback. In various embodiments, determining the statistics includes determining an average value and a standard deviation for the previous flowbacks. In various embodiments, the average value can be an arithmetic mean, a geometric average, a weighted average or any other average obtained by suitable methods. In addition, an alarm level indicating when the flowback volume is outside of a normal flowback region can be set at one standard deviation from the average value, two standard deviations from the average value or any selected multiple of standard deviations from the average value. In general, the average value and standard deviation are determined from N previous flowbacks. Thus, the average is a moving average in which the oldest flowback is dropped from the averaging process once a new flowback is recorded. In another embodiment, flowbacks within a selected time period prior to the current flowback are used in determining the average value and standard deviation.

When the pump is turned off, sensors $S_1$, $S_2$ and $S_3$ measure various flow parameters, such as flow rate, pit volume total and rate of change in pit volume with time (i.e. flowback). These measured flow parameters are communicated to surface control unit 140 that performs the methods described herein. These flow parameters are obtained at a sampling interval that can be selected by an operator, thereby providing a data set of parameters obtained at $t_0$, $t_1$, . . . $t_M$, wherein time is measured from the start of the flowback. In an exemplary embodiment, the selected sampling interval is about 2 seconds. For each sampling interval, a dataset is saved to the control unit 140 and becomes available to the display and alarm system 150. The data set generally includes time and current parameter values as well as calculated averages and standard deviations.

Average values are calculated for each sampling interval $t_0$, $t_1$, . . . $t_M$, and the average values for each sampling interval are plotted against time at the display and alarm system 150 to produce a curve that represents an average or "normal" flowback. The average value at a selected sampling interval is determined using values from corresponding sampling intervals in the last N flowback curves. For example, the average value of a flowback parameter at 60 seconds after the onset of flowback is determined using measurements from the previous N flowback parameters that were obtained at 60 seconds after the onset of their respective flowbacks. In one embodiment, the average value is an arithmetic mean, as shown in Eq. (1):

$$\mu = \frac{1}{N}\sum_{i=1}^{N} x_i \qquad \text{Eq. (1)}$$

where $x_1, x_2, \ldots, x_N$ are the last N flowback data samples, with $x_1$ being the most recent flowback sample and $x_N$ being the oldest flowback sample. In one embodiment, this average (and subsequent standard deviation) is calculated by excluding special events like kicks, flowchecks, SCR's (slow circulation rates), etc. In one embodiment, the value of N is selected to be 7. However, the number N can be any number that is suitable to an operator.

Smart alarm curves can be defined using the average μ plus or minus a multiple of statistical deviations. The standard deviation is generally obtained using Eq. (2):

$$\sigma = \sqrt{\frac{1}{N}\sum_{i=1}^{N}(x_i - \mu)^2} \qquad \text{Eq. (2)}$$

where μ is the average of the last N flowback samples at a given elapsed time since the onset of flowback. Having calculated flowback averages and standard deviations, the control unit 140 supplies a dataset to the display and alarm system 150 and curves representative of the dataset values are plotted at the display and alarm system 150. The data set can include time, current value, $\mu$, $\mu+\sigma$, $\mu-\sigma$, $\mu+2\sigma$ and/or $\mu-2\sigma$. In addition, the dataset can include $\mu+\Delta\sigma$ and/or $\mu-\Delta\sigma$ where $\Delta$ is a positive number that can be selected by an operator. The smart alarm can be set to correspond to any of the curves $\mu+\sigma$, $\mu-\sigma$, $\mu+2\sigma$, $\mu-2\sigma$, $\mu+\Delta\sigma$ and $\mu-\Delta\sigma$ according to the operator's selection. Alternatively, the smart alarm can be set at a curve related to any other deviation value, i.e., an average absolute deviation, a mean average deviation, etc. Regardless of which curve is used as selected alarm limit, an alarm is triggered when a current flowback parameter crosses from a region that is indicative of normal flowback to a region that is indicative of non-normal activity, such as a kick or a loss. In an exemplary embodiment, the alarm is triggered when the current flowback parameter is greater than the selected smart alarm limit curve. The alarm can be an audible alarm, a visual alarm, or any other suitable alarm.

In one embodiment, the calculated data set is displayed on an X-Y scatter plot at the display and alarm system 150. The dataset values are plotted on the X-Y scatter plot to produce curves for $\mu$, $\mu+\sigma$, $\mu-\sigma$, $\mu+2\sigma$, $\mu-2\sigma$, $\mu+\Delta\sigma$ and/or $\mu-\Delta\sigma$, as selected by the operator. The current flowback parameter values can also be plotted on the X-Y scatter plot as the values are obtained. The X-Y scatter plot can be provided in real-time to a rig-site, monitoring centers and/or operator or office personnel via remote communications equipment. While the exemplary embodiment plots flowback volume against time, other parameter values such as a pit volume total, a volumetric drilling pit rate changes, etc. can also be plotted in various embodiments. In addition, other curves, such as a difference curve between the current flowback and the average curve, can be plotted in various embodiments.

Figure 2:
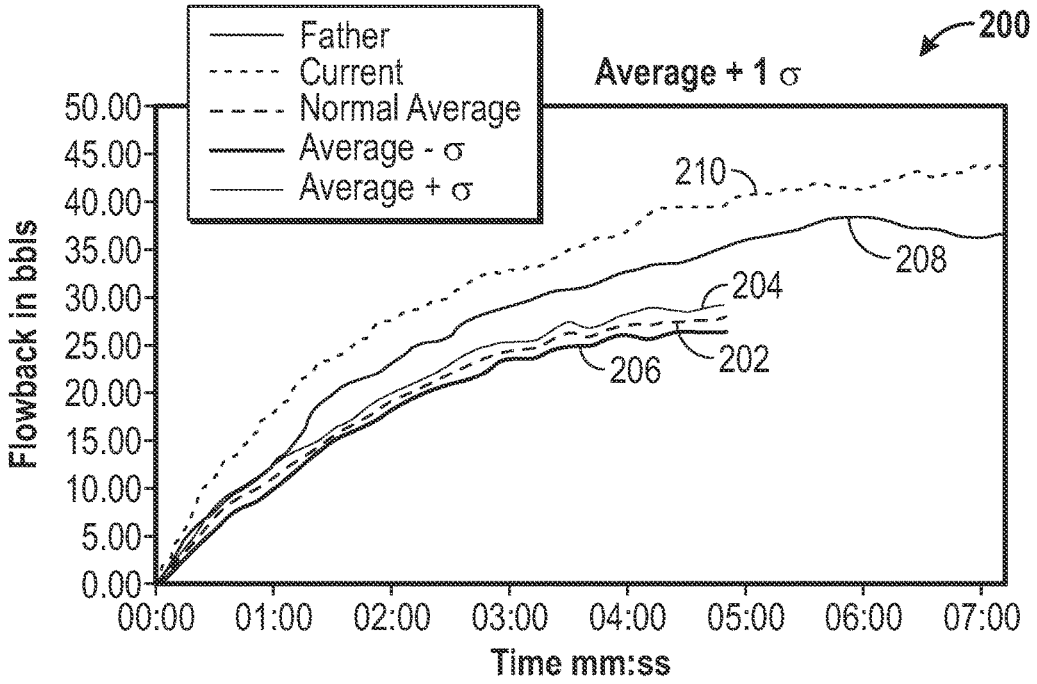
FIG. 2 shows an exemplary plot of dataset curves suitable for implementing a smart alarm according to an embodiment of the present disclosure.

FIG. 2 shows an exemplary plot 200 of dataset curves suitable for implementing a smart alarm according to one embodiment of the present disclosure. The exemplary plot 200 displays flow back volume (in barrels) along the Y-axis and time (in minutes) along the X-axis. An "average" curve 202 indicates the average of flowback curves for a selected number of prior flowbacks. Curves 204 and 206 indicate curves for $\mu+\sigma$ and $\mu-\sigma$, respectively. In general, 68% of flowback curves will lie within one standard deviation of the average curve, i.e. between curves 204 and curve 206. As seen in FIG. 2, flowback curve 208 ("father curve") and flowback curve 210 ("current curve") are greater at all times than the curve 204 indicating one standard deviation. The term "father curve" is used to indicate the flowback curve that immediately precedes the current curve. Similarly, a "grandfather curve" is used to indicate the flowback curve that immediately precedes the father curve, etc. In FIG. 2, father curve 208 corresponds to a minor kick and current curve 210 corresponds to a major kick. When the operator selects the curve 204 as a smart alarm limit curve, curves 208 and 210 will trigger the alarm at early onset of flowback.

Figure 3:
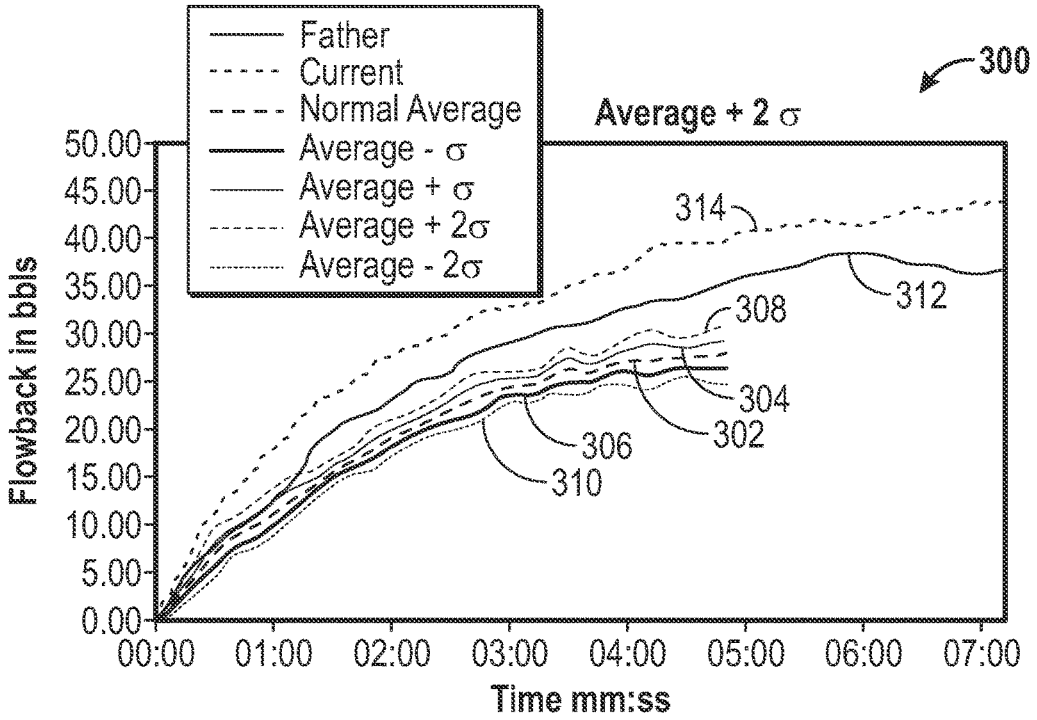
FIG. 3 shows an alternate plot of dataset curves suitable for implementing a smart alarm according to another embodiment of the present disclosure.

FIG. 3 shows an alternate plot 300 of dataset curves suitable for implementing a smart alarm according to another embodiment of the present disclosure. Flowback volume is plotted in barrels along the Y-axis and time is plotted in minutes along the X-axis. Curve 302 represents an average of N previous flowbacks. Curves 304 and 306 indicate $+\sigma$ and $-\sigma$ deviations from the average value curve 302. Curves 308 and 310 indicate $+2\sigma$ and $-2\sigma$ deviations from the average value curve 302. In general, 95% of normal flowbacks will lie between curves 308 and 310. In FIG. 3, an alarm is set to trigger when a curve leaves the region bounded by curves 308 and 310, such as by crossing above the $\mu+2\sigma$ curve 308 or below the $\mu-2\sigma$ curve 310. Father flowback curve 312 (representing a minor kick) crosses above curve 308 at about 1 minute after onset. Thus, curve 312 triggers an alarm at about one minute after onset of flowback. Current curve 314 (representing a major kick) is above the $\mu+2\sigma$ curve 308 almost from the onset of flowback. Thus, curve 314 triggers an alarm almost as soon as the onset of flowback occurs.

In another embodiment, a determination can be made whether a curve that crosses an alarm curve is a false positive. Some normal flowbacks can leave a "normal" region defined by a selected upper bound curve and lower bound curve for a brief time only to cross back into the normal region. Therefore, in one embodiment, a timer can be started when a flowback curve leaves the normal region to determine how long the current flowback curve remains outside of the normal region. An out-of-bounds time threshold can be selected, for instance, 30 seconds. Therefore, if the current flowback curve remains outside of the normal region for more than 30 seconds, an alarm is triggered. This method can also be used for flowback curves that rise above an upper bound curve or drop below a lower bound curve.

In another embodiment, an alarm limit can be set by the operator using a fixed limit. When a difference between the current curve and the average curve exceeds a fixed threshold value, the alarm is triggered. An exemplary threshold value may be 5 barrels, so that when the current curve differs from the average curve by 5 barrels, the alarm is triggered to indicate a kick.

Figure 4:
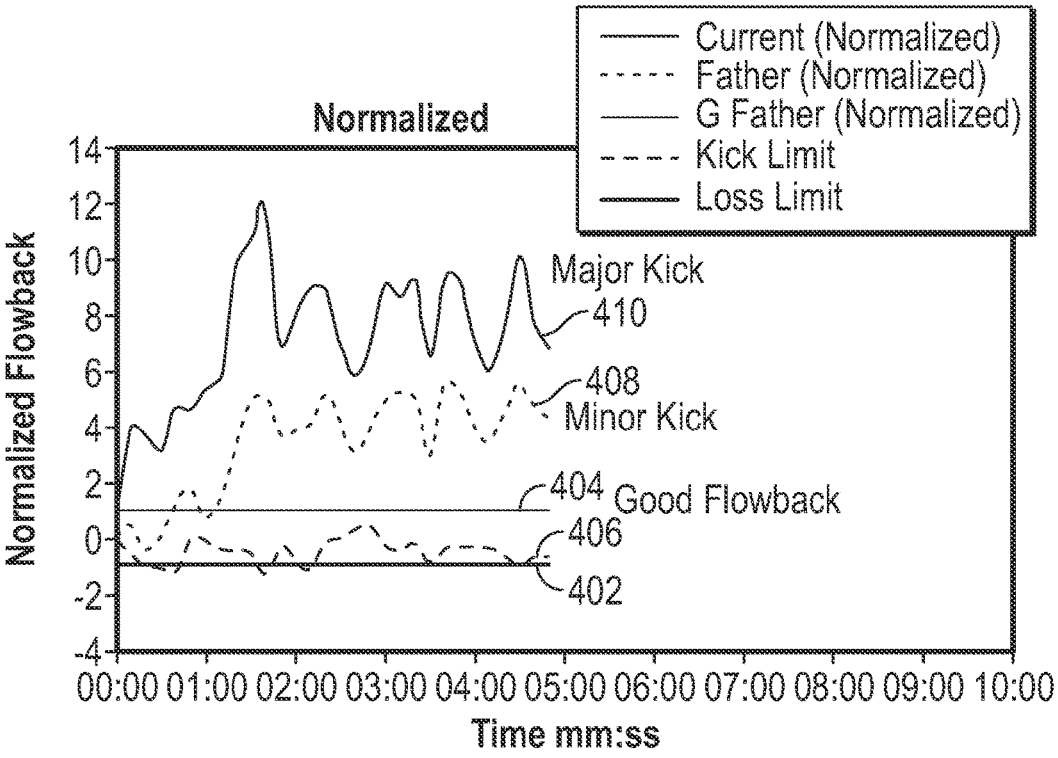
FIG. 4 shows another plot that can be used in another embodiment of the present disclosure for implanting a smart alarm system.

FIG. 4 shows another X-Y scatter plot 400 that can be used in another embodiment of the present disclosure. In the X-Y scatter plot 400, normalized flowback is plotted along the Y-axis and time is plotted in minutes along the X-axis. The normalized display can be a more intuitive display for a human operator than the displays of FIGS. 2 and 3. Normalized curves can be calculated using Eq. (3) below:

$$\Delta = \frac{x-\mu}{\sigma} \qquad \text{Eq. (3)}$$

Upper and lower bound curves, such as 204 and 206 in FIG. 2 appear as straight lines 404 and 402, respectively. The average value is indicated as y=0 on the plot 400. Therefore, line 204 (y=+1) indicates one standard deviation from the normal value. Line 206 (y=−1) indicates −1 standard deviation from the normal value. Curves 406, 408 and 410 represent normalized curves for a good flowback, a flowback having a minor kick and a flowback having a major kick, respectively. For the normalized display, an alarm is triggered when the flowback crosses either above the $\mu+\sigma$ line 404 or below the $\mu-\sigma$ line 402.

Therefore, in one aspect, the present disclosure provides a method of determining an influx at a wellbore, the method including obtaining a flowback parameter for plurality of flowback events at the wellbore prior to a current flowback event; determining an average of the flowback parameter ($\mu$) and a standard deviation ($\sigma$) of the flowback parameter from the plurality of prior flowback parameters; setting an alarm threshold based on the determined average and the standard deviation; measuring a current flowback parameter; and determining the influx when the current flowback parameter meets the alarm threshold. The method may further determine a kick when the current flowback parameter is greater than $\mu+\Delta\sigma$, where $\Delta$ is a positive number; and determine a loss when the current flowback parameter is less than $\mu-\Delta\sigma$, where $\Delta$ is a positive number. In various embodiments, the determined average is a moving average of one of: (i) a selected number of prior flowback measurements; and (ii) prior flowback measurements occurring within a selected time period prior to the current flowback event. An action can be performed to reduce influx when the flowback parameter meets the alarm threshold. In one embodiment, a duration of time that the current flowback parameter exceeds the alarm threshold can be measured and the influx is determined when the measured time duration exceeds a selected time threshold. The current flowback parameter and the alarm threshold can be displayed as one of: (i) a graph of the parameter vs. time; and (ii) a normalized graph of the parameter vs. time. On the normalized graph, the alarm threshold appears as a straight line. The average can be one of: (i) an arithmetic mean; (ii) a geometric mean; and (iii) a weighted average.

In another aspect, the present disclosure provides an apparatus for determining an influx at a wellbore, the apparatus including: a sensor configured to obtain a parameter of a current flowback; and a processor configured to: determine an average flowback parameter ($\mu$) and a standard deviation ($\sigma$) of the parameter for prior flowbacks, set an alarm threshold based on the determined average and standard deviation, compare the measured current parameter to the alarm threshold, and trigger an alarm to indicate the influx when the current parameter meets the alarm threshold. The processor can further determine a kick when the current parameter is greater than $\mu+\Delta\sigma$, where $\Delta$ is a positive number and determine a loss when the current parameter is less than $\mu-\Delta\sigma$, where $\Delta$ is a positive number. The determined average can be a moving average of one of: (i) a selected number of prior flowback measurements; and (ii) prior flowback measurements occurring within a selected time period immediately prior to the current flowback. The processor can further perform an action to reduce influx when the flowback parameter meets the alarm threshold. The processor can further measure a duration of time that the current parameter exceeds the alarm threshold and determine the influx when the measured duration of time exceeds a selected time threshold. The processor can further display the current parameter and the alarm threshold on one of: (i) a graph of the parameter vs. time; and (ii) a normalized graph of the parameter vs. time. The alarm threshold appears as a straight line on the normalized graph. In various embodiments, the processor determines an average that is one of: (i) an arithmetic mean; (ii) a geometric mean; and (iii) a weighted average.

In yet another aspect, the present disclosure provides a computer-readable medium accessible to a processor and having instructions stored thereon that when read by the processor enable the processor to perform a method of determining an influx at a wellbore, the method including: obtaining a flowback parameter for plurality of flowback events at the wellbore prior to a current flowback event; determining an average of the flowback parameter ($\mu$) and a standard deviation ($\sigma$) of the flowback parameter from the plurality of prior flowback parameters; setting an alarm threshold based on the determined average and the standard deviation; measuring a current flowback parameter; and determining the influx when the current flowback parameter meets the alarm threshold. The current flowback parameter and the alarm threshold can be displayed on one of: (i) a graph of the parameter vs. time; and (ii) a normalized graph of the parameter vs. time, in various embodiments. Additionally, the processor may perform an action to reduce influx when the flowback parameter meets the alarm threshold.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

What is claimed is:

1. A method of controlling an influx at a wellbore, comprising:

obtaining flow rates for a plurality of flowback events at the wellbore prior to a current flowback event;

determining an average ($\mu$) and a standard deviation ($\sigma$) of the flow rates from the plurality of prior flow rates;

setting an alarm threshold defining a normal flowback condition based on the determined average and the standard deviation;

measuring a current flow rate;

triggering an alarm to indicate the current flow rate is outside of the normal flowback condition when the current flow rate meets the alarm threshold; and controlling a mud pump of the drilling operation in response to the alarm to control the current flow rate back to the normal flowback condition.

2. The method of claim 1, further comprising determining a kick when the current flow rate is greater than $\mu+\Delta\sigma$, where $\Delta$ is a positive number; and determining a loss when the current flow rate is less than $\mu-\Delta\sigma$, where $\Delta$ is a positive number.

3. The method of claim 1, wherein the determined average is a moving average of one of: (i) a selected number of prior flow rates; and (ii) prior flow rate measurements occurring within a selected time period prior to the current flowback event.

4. The method of claim 1, further comprising performing an action to reduce influx when the current flow rate meets the alarm threshold.

5. The method of claim 1, further comprising measuring a duration of time that the current flow rate exceeds the alarm threshold and determining the influx when the measured time duration exceeds a selected time threshold.

6. The method of claim 1, further comprising displaying the current flow rate and the alarm threshold on one of: (i) a graph of the flow rate vs. time; and (ii) a normalized graph of the flow rate vs. time.

7. The method of claim 6, wherein the alarm threshold appears as a straight line on the normalized graph.

8. The method of claim 1, wherein the average is one of: (i) an arithmetic mean; (ii) a geometric mean; and (iii) a weighted average.

9. An apparatus for controlling an influx at a wellbore, comprising:

a sensor configured to obtain a flow rate of a current flowback; and a processor configured to:

determine an average ($\mu$) and a standard deviation ($\sigma$) of the flow rate for prior flowbacks, set an alarm threshold defining a normal flowback condition based on the determined average and standard deviation, compare the measured current flow rate to the alarm threshold, trigger an alarm to indicate the current flow rate is outside of the normal flowback condition when the current flow rate meets the alarm threshold; and controlling a mud pump of the drilling operation in response to the alarm to control the current flow rate back to the normal flowback condition.

10. The apparatus of claim 9, wherein the processor is further configured to determine a kick when the current flow rate is greater than $\mu+\Delta\sigma$, where $\Delta$ is a positive number; and determine a loss when the current flow rate is less than $\mu-\Delta\sigma$, where $\Delta$ is a positive number.

11. The apparatus of claim 9, wherein the determined average is a moving average of one of: (i) a selected number of prior flow rate measurements; and (ii) prior flow rate measurements occurring within a selected time period immediately prior to the current flowback.

12. The apparatus of claim 9, wherein the processor is further configured to perform an action to reduce influx when the flow rate meets the alarm threshold.

13. The apparatus of claim 9, wherein the processor is further configured to measure a duration of time that the current flow rate exceeds the alarm threshold and determine the influx when the measured duration of time exceeds a selected time threshold.

14. The apparatus of claim 9, wherein the processor is further configured to display the current flow rate and the alarm threshold on one of: (i) a graph of the parameter vs. time; and (ii) a normalized graph of the parameter vs. time.

15. The apparatus of claim 14, wherein the alarm threshold appears as a straight line on the normalized graph.

16. The method of claim 1, wherein the processor is configured to determine an average that is one of: (i) an arithmetic mean; (ii) a geometric mean; and (iii) a weighted average.

17. A non-transitory computer-readable medium accessible to a processor and having instructions stored thereon that when read by the processor enable the processor to perform a method of controlling an influx at a wellbore, the method comprising:

obtaining flow rates for plurality of flowback events at the wellbore prior to a current flowback event;

determining an average($\mu$) and a standard deviation ($\sigma$) of the flow rates from the plurality of prior flow rates;

setting an alarm threshold defining a normal flowback condition based on the determined average and the standard deviation;

measuring a current flow rate; and triggering an alarm to indicate the current flow rate is outside of the normal flowback condition when the current flowback parameter meets the alarm threshold; and controlling a mud pump of the drilling operation in response to the alarm to control the current flow rate back to the normal flowback condition.

18. The computer-readable medium of claim 17, wherein the method further comprises determining a kick when the current flow rate is greater than $\mu+\Delta\sigma$, where $\Delta$ is a positive number; and determining a loss when the current flow rate is less than $\mu-\Delta\sigma$, where $\Delta$ is a positive number.

19. The computer-readable medium of claim 17, wherein the determined average is a moving average of one of: (i) a selected number of prior flow rate measurements; and (ii) prior flow rate measurements occurring within a selected time period prior to the current flowback event.

20. The computer-readable medium of claim 17, wherein the method further comprises measuring a duration of time that the current flow rate exceeds the alarm threshold and determining the influx when the measured time duration exceeds a selected time threshold.

* * * * *